US008018160B2

(12) United States Patent
Brady

(10) Patent No.: US 8,018,160 B2
(45) Date of Patent: Sep. 13, 2011

(54) MAGNETRON HAVING A FEATURE FOR COLLECTING MATERIAL LOST FROM A CATHODE THEREOF

(75) Inventor: Michael Barry Clive Brady, Maldon (GB)

(73) Assignee: E2V Technologies (UK) Limited, Chelmsford (GB)

( * ) Notice: Subject to any disclaimer, the term of this patent is extended or adjusted under 35 U.S.C. 154(b) by 637 days.

(21) Appl. No.: 12/073,467

(22) Filed: Mar. 5, 2008

(65) Prior Publication Data

US 2008/0238558 A1 Oct. 2, 2008

(30) Foreign Application Priority Data

Mar. 30, 2007 (GB) ..... 0706298.7

(51) Int. Cl.
*H01J 25/50* (2006.01)

(52) U.S. Cl. ..... 315/39.67; 204/192.12; 204/192.33

(58) Field of Classification Search ..... 315/39.51, 315/39.63, 39.67; 204/192.12, 298.04, 298.14, 204/192.32, 192.33
See application file for complete search history.

(56) References Cited

U.S. PATENT DOCUMENTS

| | | | | |
|---|---|---|---|---|
| 2,452,272 | A * | 10/1948 | Tiley | 315/39.77 |
| 4,219,397 | A | 8/1980 | Clarke | |
| 5,073,245 | A * | 12/1991 | Hedgcoth | 204/298.21 |
| 6,495,000 | B1 | 12/2002 | Atkinson et al. | |
| 2006/0220566 | A1 * | 10/2006 | Brady | 315/39.51 |

OTHER PUBLICATIONS

United Kingdom Search Report dated Aug. 29, 2007, directed to counterpart GB0706298.7 application.

* cited by examiner

*Primary Examiner* — Thuy Vinh Tran
(74) *Attorney, Agent, or Firm* — Venable LLP; Robert Kinberg

(57) ABSTRACT

A magnetron has a cathode, an anode with vanes, and an insulating surface which faces the cathode and receives material from the cathode due to sputtering at the cathode. A conductor enables the resistance of the film so deposited to be measured, giving an indication of the thickness of the film and the lifetime of the magnetron.

8 Claims, 1 Drawing Sheet

MAGNETRON HAVING A FEATURE FOR COLLECTING MATERIAL LOST FROM A CATHODE THEREOF

CROSS-REFERENCE TO RELATED APPLICATION

This application claims the priority of GB 0706298.7, filed Mar. 30, 2007, the disclosure of which is incorporated herein by reference.

BACKGROUND

This invention relates to magnetrons.

All vacuum tubes reach the end of their life when the electron emissive material on the cathode is entirely lost by evaporation or sputtering. All vacuum tubes except for magnetrons and other crossed beam tubes lose their active cathode material mainly by evaporation. Evaporation depends entirely on the temperature at which the cathode is operated and not on the running level so if the cathode temperature is known the life of the device can be predicted sufficiently accurately for most users. The life of magnetrons and similar tubes is difficult to predict, because the cathode material is lost mainly by sputtering.

Sputtering means that the cathode material is lost by ion bombardment. Ions are created in magnetrons, and in other vacuum tubes, by the collision of electrons with gas atoms, the gas atoms evaporating from the vacuum envelope and the material of the cathode. Negative ions will be attracted to the positive parts of the vacuum device, and positive ions will be accelerated towards the cathode and cause the loss of material. Magnetrons suffer much more from cathode damage by sputtering than do other vacuum devices, because the cathode is centrally located in the area where ions are likely to be created, current densities, implying more electrons to ionise atoms, are higher than in beam tubes, the cathode is large compared to that in an equivalent beam tube and is a source of gas for evaporation, and the vacuum volume is much less than in an equivalent beam tube, so residual gas densities will be higher.

The rate of sputtering is dependent on: the quality of the device processing, since the residual gas levels can be reduced by processing at higher temperatures and for longer; power rating (more cathode current implies more electrons which can cause ionisation); temperature of the vacuum envelope (since raising its temperature will increase the gas level); input and output conditions; and fault events (such as arcing which can cause local overheating, thus producing gas).

Magnetrons are often used at different power outputs on an hour by hour basis (for example when used in medical linear accelerators different treatment types require significantly different power levels, surface cancers needing low power and X-ray treatment needing high power) and this combined with variations in running temperature in use and any variation in processing makes the life variable and unpredictable.

Magnetrons are used as the microwave source in radar, medical linear accelerators and some industrial processes. In all these the user needs to carry out preventive maintenance to reduce unplanned downtime. To minimize the risk of equipment failure the user would like to replace items with a limited life very shortly before they fail. To do this the life needs to be predictable regardless of different operational conditions and tube history.

SUMMARY OF THE INVENTION

The invention provides a magnetron which includes an insulating surface which is exposed to the cathode to receive material lost therefrom in operation.

The material collected on the surface will be related, for example, proportional, to the cumulative loss from the cathode and it becomes possible to estimate the end of life of the magnetron.

DESCRIPTION OF THE DRAWINGS

Ways of carrying out the invention will now be described in detail, by way of example, with reference to the accompanying drawings, in which.

DESCRIPTION OF A PREFERRED EMBODIMENT

Figure 1:
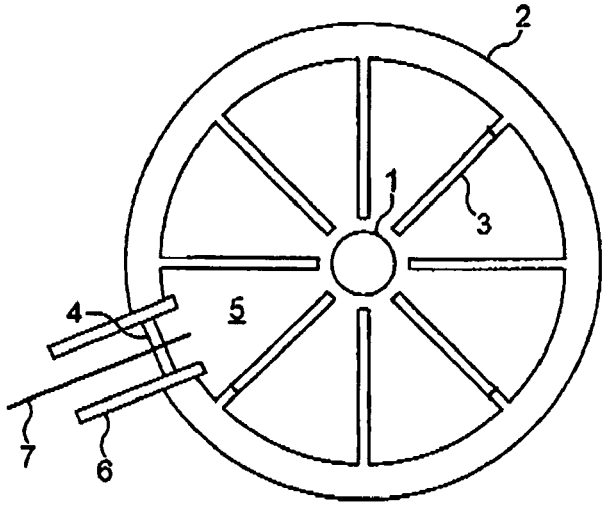
FIG. 1 is a schematic axial cross-sectional view through a first magnetron according to the invention, in which the cavities are defined by vanes.

Like reference numerals have been given to like parts throughout all the ray Figures.

Referring to FIG. 1, the magnetron comprises a cathode 1, and an anode 2 which includes vanes 3. The interior of the magnetron is evacuated, and the cathode maintained at a high negative potential. Pole pieces (not shown) provide a magnetic field in an axial direction.

In accordance with the invention, a ceramic disc 4 is mounted at the rear of one anode cavity 5, the ceramic disc facing towards, and being in the line of sight of, the cathode 1. The disc is mounted in a sleeve 6 of an alloy, which is brazed to the interior of an opening formed in the anode wall. A lead 7 extends through the ceramic disc. The periphery of the disc is metallised and brazed to the interior of the sleeve. The integrity of the vacuum in the anode is thus maintained.

In use of the magnetron, cathode material will be sputtered from the cathode and travel in straight lines to the anode, pole pieces, vanes and, since it is exposed the cathode, to the ceramic disc 4. The cathode material landing on the ceramic disc will form a conducting film. The sputtered material will be a mixture of cathode base metal such as nickel or molybdenum and active material such as barium and strontium and or their oxides. The sputtered material will form an electrically conducting film on the surface the resistance of which will be inversely proportional to the thickness of the sputtered material. The resistance of this film is measured via the lead in the centre of the ceramic disc, measuring the resistance between the lead and the sleeve 6 (or any point on the exterior of the magnetron). The resistance of the deposited film can be used to monitor the amount of sputtered material continuously so the remaining life is always known. The resistance measurements are compared with a reference value found by experiment to correspond to the end of life of the magnetron.

The amount of material the cathode has lost by the end of its life is known: a number of magnetrons are tested and the monitored resistance values are compared with loss of diode emission which also is a life indicator, and the resistance value at the end of life is noted. It would also be possible to measure the resistance value at any time and open the magnetron at that point and measure the loss of material from the cathode, in order to produce reference values. The customer can then plan for replacement.

Because the ceramic disc 4 is positioned near the back of a cavity, it will not be exposed to electrical fields. The central conductor and the aperture in the anode in which it sits act as a coaxial line shielding the lead from any RF pick up.

Other advantages are that the sputtering rate could be measured on initial tests by the manufacturer giving a early warning of processing faults, and any equipment fault which causes excess sputtering and would shorten life is can be seen. The user can determine how the operational conditions affect the life of the magnetron, 1. The wear and wear rate can be monitored continuously while the tube is operational, on standby or on the shelf as a spare. The invention is applicable to all frequencies, power levels and uses of magnetrons, although it would be more difficult (although possible) to incorporate in magnetrons operating at higher frequencies, such as greater than 5 GHz, because of their small size.

In the above embodiment, the disc may be 3 mm in diameter. The ceramic material may be alumina. The ceramic disc may be painted with molybdenum/manganese paint and then fired at a high temperature (for example, 1600° C.), so that the paint bonds to the ceramic to give a surface that can be soldered using high temperature solders. The material of the sleeve may be Kovar or a similar alloy which has the same thermal expansion as the ceramic disc and can thus be joined to the disc easily. The lead 7 may be sealed to the disc by sintering a metallised layer to the disc surface around the hole. The lead may then brazed to the metallised layer using a gold/silver/copper/nickel solder.

Variations are of course possible without departing from the scope of the invention. Thus, types of insulating material other than ceramic can be used. The insulating material can be placed anywhere within line of sight of the cathode to collect sputtered material. If the insulator is transparent and the cathode can be viewed through it (the cathode would typically be operated at between 750° C. and 1000° C. and so would glow red), the reduction of light transmission could also be used as a measure of the sputtered material film. This method however suffers from the disadvantages that the temperature of the cathode and hence its luminance depends not only on input conditions but the reflectivity of the anode which surrounds it, which will very with the sputtered material deposited. The reflectivity of the cathode will also be changed by sputtered material.

Figure 2:
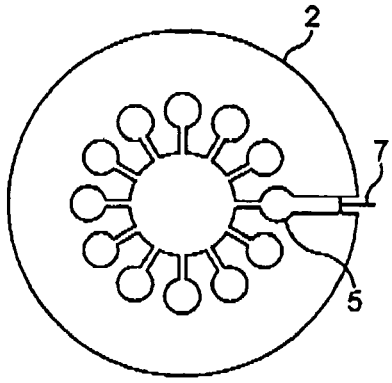
FIG. 2 is a schematic axial cross-sectional view through the anode of a second magnetron according to the invention, in which the cavities are of the hole-and-slot type.
Figure 3:
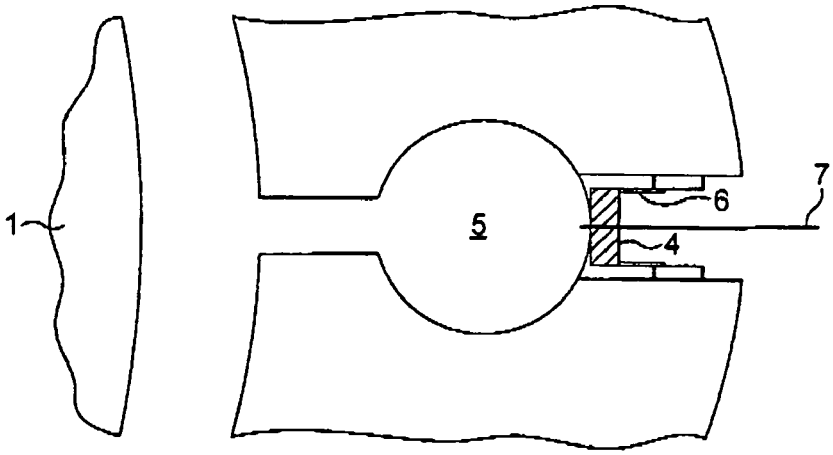
FIG. 3 is an enlarged view of a part of the magnetron shown in FIG. 2.

Referring to FIGS. 2 and 3, the second magnetron is of the hole and slot type. One of the cavities is bored through to accommodate the ceramic disc 4, which is mounted in a sleeve 6. Another sleeve 8, which has the same coefficient of expansion as the anode, is brazed to the anode, and to the sleeve 6, to which the ceramic disc 4 is in turn brazed, in order to produce a vacuum-tight connection. The construction, arrangement and operation of the ceramic disc are the same as for the first embodiment.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

The invention claimed is:

1. A magnetron which includes an insulating surface located at the rear of an anode cavity which is exposed to a cathode to receive material lost therefrom in operation including means to measure the resistance of a film of the material deposited on the insulating surface.

2. A magnetron as claimed in claim 1, in which the means for measuring the resistance includes a conductor extending through the insulating surface.

3. A magnetron as claimed in claim 1, in which the insulating surface is defined by an area of ceramic material.

4. A magnetron as claimed in claim 3, in which the ceramic material is alumina.

5. A magnetron, comprising:

a cathode;

an anode cavity having a rear region remote from the cathode;

an insulating surface located in the rear region of the anode cavity and being exposed to the cathode to receive material lost from the cathode in operation; and a device to measure resistance of a film of material deposited on the insulating surface.

6. The magnetron as claimed in claim 5, wherein the device to measure resistance includes a conductor extending through the insulating surface.

7. The magnetron as claimed in claim 5, wherein the insulating surface comprises an area of ceramic material.

8. A magnetron as claimed in claim 7, wherein the ceramic material comprises alumina.

* * * * *